US005636943A

United States Patent [19]

Haney

[11] Patent Number: 5,636,943

[45] Date of Patent: Jun. 10, 1997

[54] HYDROSTATIC EQUALIZER

[75] Inventor: James A. Haney, Houston, Tex.

[73] Assignee: McDermott International, Inc., New Orleans,, La.

[21] Appl. No.: 550,307

[22] Filed: Oct. 30, 1995

[51] Int. Cl.[6] ..... E02B 17/02; B63G 8/22; E02D 29/00

[52] U.S. Cl. ..... 405/195.1; 114/33; 405/185; 405/203; 405/205

[58] Field of Search ..... 405/195.1, 203, 405/204, 205, 206, 207, 208, 171, 172, 185, 186, 224, 225, 227; 114/312, 333

[56] References Cited

U.S. PATENT DOCUMENTS

| | | | |
|---|---|---|---|
| 3,410,778 | 11/1968 | Krasberg | 405/185 X |
| 3,716,009 | 2/1973 | Strickland | 114/333 |
| 4,014,176 | 3/1977 | Weidler | 405/203 |
| 4,187,796 | 2/1980 | Ess | 114/312 |
| 4,191,494 | 3/1980 | Nakamura et al. | 405/171 |
| 4,240,767 | 12/1980 | Gracia | 405/205 X |
| 4,266,500 | 5/1981 | Jurca | 114/333 |
| 4,696,602 | 9/1987 | Daigle et al. | 405/203 X |
| 4,772,158 | 9/1988 | Coone | 405/195.1 X |
| 5,184,921 | 2/1993 | Hancock | 405/171 |
| 5,482,405 | 1/1996 | Tolksdorf et al. | 405/185 X |
| 5,551,800 | 9/1996 | Hobelsberger | 405/185 X |

*Primary Examiner*—Dennis L. Taylor
*Attorney, Agent, or Firm*—R. J. Edwards; D. Neil LaHaye

[57] ABSTRACT

An apparatus and method for pressurizing the inside of tubular members of an offshore structure that are immersed in sea water so that the internal pressure resists the hydrostatic pressure of the sea water. To achieve this internal pressure, gas is generated automatically on the inside of the members as the structure descends to its in-place location. The gas can also be used to deballast a tubular member.

8 Claims, 2 Drawing Sheets

HYDROSTATIC EQUALIZER

FIELD AND BACKGROUND OF THE INVENTION

The present invention relates, in general, to offshore platforms fabricated from tubular members, and more particularly to the problem of reducing or eliminating the effect of hydrostatic pressure on the design of tubular members immersed in sea water as well as a method of deballasting such tubular members.

As is well known to those practiced in the art, the structural members of an offshore platform which are immersed in sea water usually are tubulars and must be designed to resist net external hydrostatic pressure in combination with whatever other loads are imposed on the structural members. The structures normally must be designed to float so that they can be installed using controlled ballasting techniques. Thus, during installation most of the structural members have one atmosphere of pressure on the inside and are exposed to the ambient pressure on the outside. After installation, the structural members are normally left void because it would be undesirable and impractical to flood the structural members after the installation. Thus, most of the structural members that are immersed in sea water are exposed to the full ambient hydrostatic pressure during installation and during the life of the structure. For convenience and brevity, the terms "tubular", "tubulars", "tubular members", and "tubular structures" will be used throughout this description to generally refer to the legs and truss members used in offshore structures.

The hydrostatic pressure induces hoop compression in the tubulars. Also, the hydrostatic end force induces axial compression in the tubulars. The stresses in the structural members caused by the hydrostatic pressure require extra wall thickness and often require that compression reinforcing rings be attached to the structural members at intervals along their lengths. These rings prevent instability and subsequent flattening of the tubular under the action of hydrostatic pressure. The deeper the water and the larger the member diameter, the greater is the expense related to hydrostatics. Ultimately, in deep enough water it becomes impractical to use void members, which means that extra buoyancy must be provided higher up in the structure to float the structure. In short, the design of the structure for hydrostatics becomes increasingly expensive with increasing depth and finally becomes prohibitive.

Another approach to the hydrostatic problem has been considered, but it has been rejected because of concerns over safety. If the members that are most affected by hydrostatics were filled with compressed air in the fabrication yard, then after installation the internal and external pressures acting on the tubulars could be balanced, thereby eliminating the hydrostatic problem. However, to satisfy concerns for safety these tubulars would have to be designed and rated as pressure vessels, which makes the idea too costly to use.

It is also known to utilize installation plans which require the deliberate flooding of certain tubular structures, followed by deballasting or blowing out of the flooded tubulars. Usually one or two chambers in each tubular leg of a structure are flooded although any member might be selected depending on the properties of the structure made up of the tubular members. As shown in FIG. 2, deballasting is done by blowing water, shown at 32, out with compressed air or nitrogen 100, supplied by a dedicated boat through a piping system 110 built for the purpose. The jacket leg 112 is shown to have upper and lower closures 114 and 116, and water 32 is discharged through a lower valve 118 into the ocean. The amount of pressure to be applied to the air or nitrogen 100 depends on how far the tubular 112 extends below the sea level, shown at 120.

SUMMARY OF THE INVENTION

During fabrication of the offshore structure, a chemical of the required properties is placed on the inside of the structural members that are to be hydrostatically equalized during installation. The chemical is supplied in each member in the quantity required to generate a volume of gas that will create a pressure on the inside of the member that will be equal to the ambient pressure on the outside of the member, when the structure is in its final in-place position. Such a member is said to be hydrostatically equalized. The chemical reaction that generates the gas is initiated by a device that is activated by differential pressure between the inside and outside of the member. In the preferred embodiment, the initiation devices are set at differential pressures that will initiate the gas generation reaction as the structure descends to its in-place position during installation. Thus, the members are not pressurized during fabrication on shore or during installation when the members are above the surface of the ocean, which means that personnel are never exposed to any danger from a pressurized unrated tubular. In fact, the differential set pressures can be chosen so that the tubular members are not exposed to net internal or external pressure that would control the design of the member.

In a related application, deballasting of ballast chambers can be accomplished with chemical gas generation. The correct quantity of chemical is placed in members which are expected to be deliberately flooded during installation. To deballast the chamber, the chemical gas generation reaction is initiated, probably by direct intervention of personnel, and the pressure created forces the water out of the chamber through an opening in the bottom of the chamber.

The invention can be applied to any tubular member of any type of marine structure where it is desirable to equalize the internal and external pressures acting on the tubular member, or to deballast the member. Those practiced in the art will recognize that the invention can be applied advantageously to jackets and compliant towers, among other types of marine structures.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
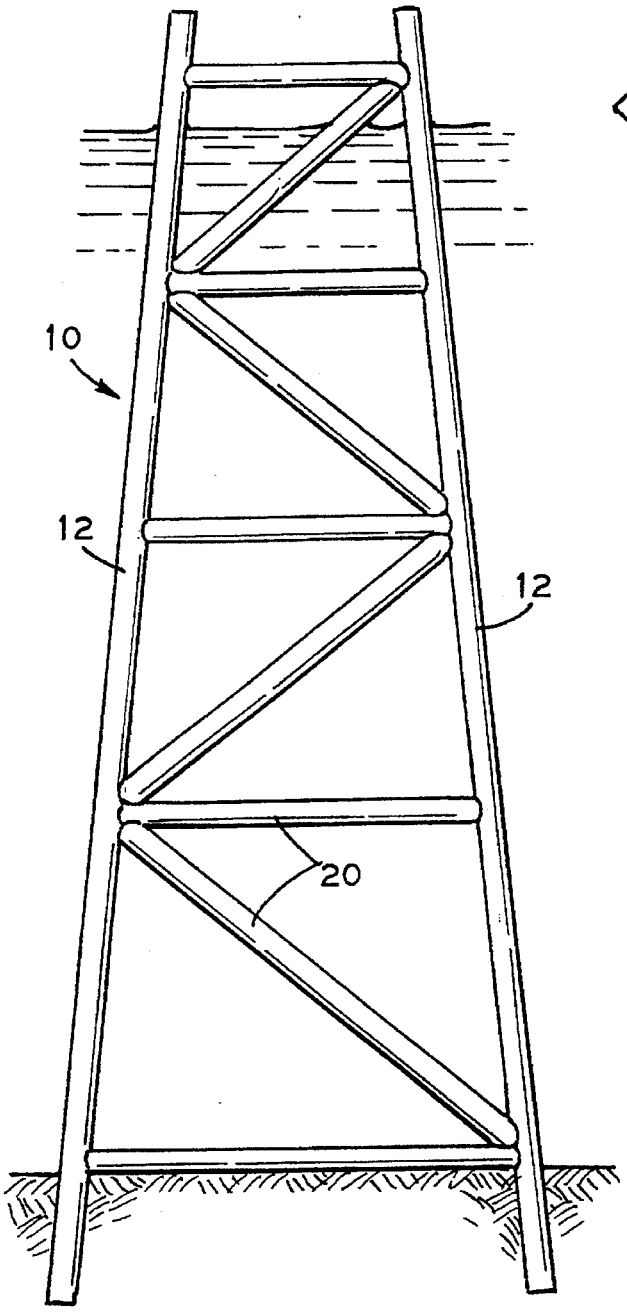
FIG. 1 is a schematic side elevational view of a truss row of a jacket on which the present invention is practiced.
Figure 2:
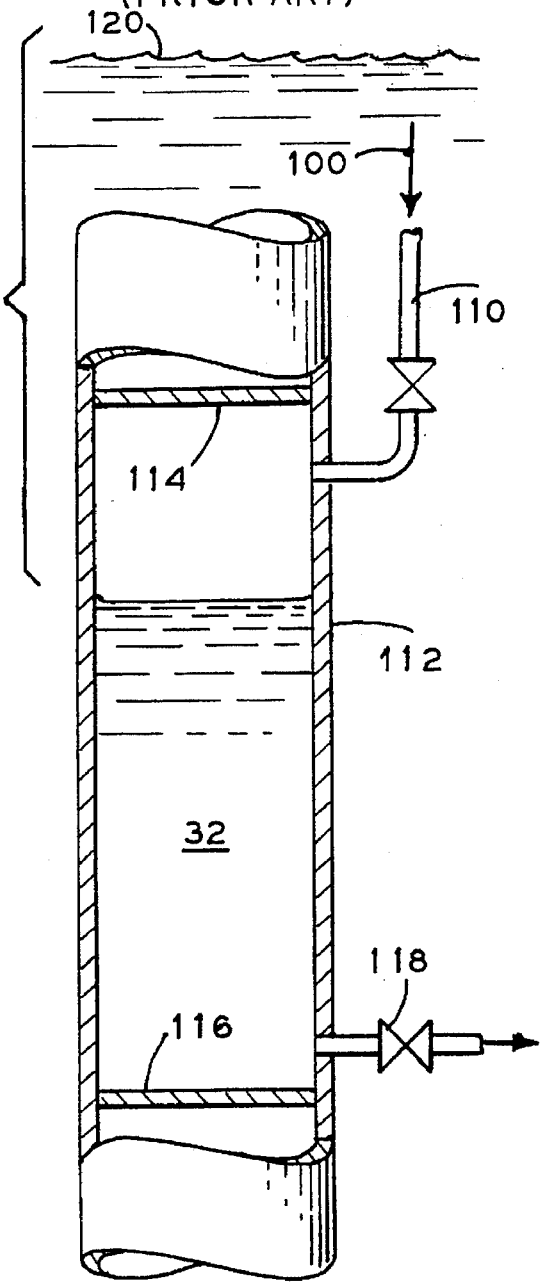
FIG. 2 (PRIOR ART)
FIG. 2 is a schematic sectional view of a jacket leg or tubular member of the prior art.

Referring to FIG. 1 in particular, tubular legs 12 and tubular truss members 20 comprise an offshore structure generally designated 10. Although a jacket 10 is shown, a compliant tower or other marine structures comprised wholly or partially of tubulars are also intended. As is well known by those practiced in the art, legs 12 and truss members 20 provide buoyancy to the structure 10 and, therefore, are void, i.e., not flooded and at atmospheric pressure. In some cases, in order to assist in installation, portions of the legs 12 or truss members 20 must be flooded during installation and subsequently deballasted, as shown in FIG. 2.

The present invention avoids subjecting selected tubulars to significant net external hydrostatic pressure by pressurizing the interior of the tubular as it descends to its final in-place elevation during installation. In the present invention, a chemical is stored inside each of the selected tubulars during fabrication of the structure. The chemical is dormant until it is activated during the descent of the tubular to its final elevation while the structure is being installed. When activated, the chemical generates gas which produces pressure in the tubular that counteracts the external hydrostatic pressure. The invention also includes use of the chemical gas generation to deballast a member that has been previously flooded.

A skilled artisan can choose from a variety of chemicals which will generate gases that are not harmful to the structure or to the environment, should the gases escape to the environment. There are also a variety of actuators that can be used to initiate the gas generating chemical reaction. The most reliable of the actuators sense the differential pressure between the inside and outside of the tubular member and initiate the reaction when a predetermined differential pressure is reached.

Figure 3:
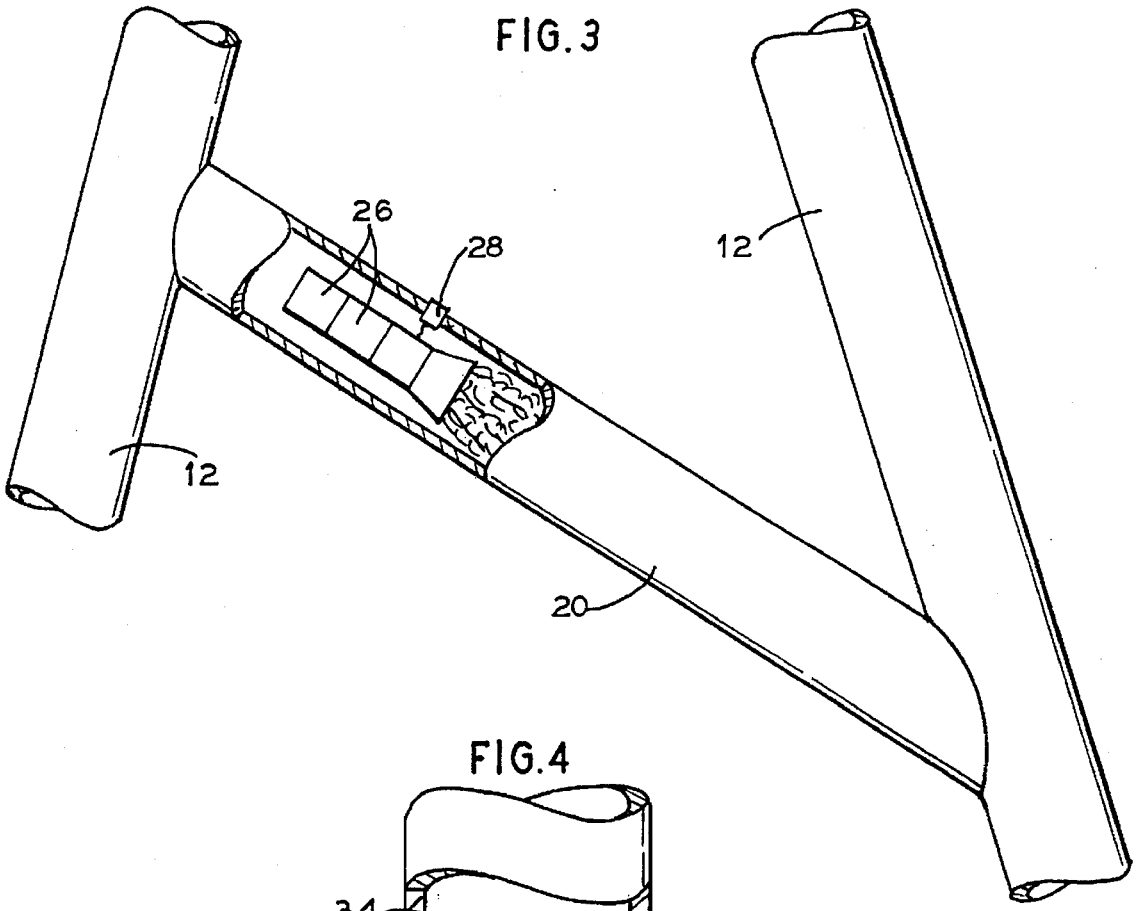
FIG. 3 is a fragmentary view of part of the truss row shown at 3 in FIG. 1, embodying the present invention.

In FIG. 3 there is shown a plurality of packages of chemicals 26 located within tubular truss member 20. Each of these packages 26 is standardized and will generate a known quantity of gas. Given the volume of the tubular 20 and the ambient in-place temperature, the designer can calculate the quantity of gas required to hydrostatically equalize tubular truss 20. Then the designer selects the combination of packages 26 that will produce the correct quantity of gas. Finally, the designer must determine the differential set pressure at which the actuator 28 will initiate the gas generating chemical reaction. The differential set pressure for each member is carefully chosen so that the reaction is initiated during the descent of the structure at an elevation that results in gas generation that will keep the differential pressure acting on each member within certain limits. Given the rate of gas generation and the rate of descent of the structure, the pressure increase on the inside of the member must remain reasonably in balance with the hydrostatic pressure increase acting on the outside of the member. This will prevent excessive net differential pressure, external or internal, from developing and damaging the member.

Figure 4:
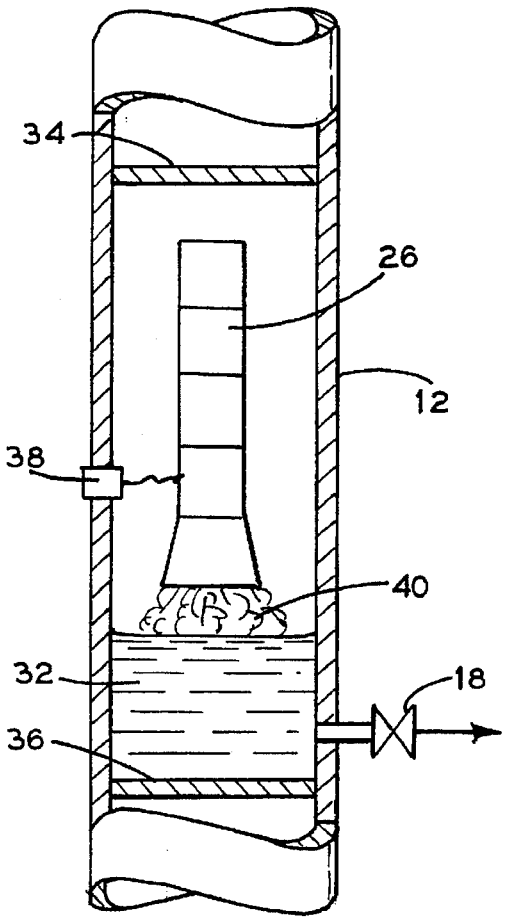
FIG. 4 is a side view of a tubular member to be deballasted according to another embodiment of the present invention.

FIG. 4 shows an alternate embodiment of the invention where a tubular member 12 is divided by bulkheads 34 and 36 into ballast compartments which can be flooded deliberately with water 32 by opening valve 18. During fabrication, chemical gas generating packages 26 are secured in the ballast compartment and connected to a reaction initiation device 38. At some time after the ballast compartment is flooded the installation plan will require that the compartment be deballasted. To deballast, reaction initiation device 38 is activated by personnel intervention, i.e., a diver, or remotely operated vehicle (ROV), or from the surface using an acoustic actuation device, or some other means. Once the reaction is initiated, the gas 40 that is generated raises the pressure within the ballast compartment and blows the water out of the ballast compartment through valve 18.

While specific embodiments of the invention have been shown and described in detail to illustrate the application of the principles of the invention, it will be understood that the invention may be embodied otherwise without departing from such principles.

What is claimed as invention is:

1. In an offshore structure having tubular legs or truss members which, in use, are at least partly submerged and exposed to inward hydrostatic pressure, an apparatus comprising:

pressure generating means protectively housed in the legs or truss members, which pressure generating means have a dormant state that exerts no excess pressure inside the legs or truss members and an activated state which generates a counterpressure in the legs or truss members for counteracting the hydrostatic pressure when the legs or truss members are submerged; and activating means operatively connected to the pressure generating means for activating the pressure generating means at a predetermined pressure differential between the interior and exterior of the legs or truss members to generate the counterpressure.

2. An apparatus according to claim 1, wherein the pressure generating means comprises at least one chemical package in the legs or truss members, the activating means comprising a mechanism for initiating the reaction of the chemical in the package to generate gas to produce the counterpressure.

3. An apparatus according to claim 2, wherein the activating means is manually activatable.

4. A method for pressurizing tubular legs or truss members of an offshore structure when the offshore structure is being installed and the legs or truss members are to be at least partly submerged, comprising:

positioning at least one pressure generating means in the legs or truss members, which pressure generating means has a dormant state which exerts no pressure above ambient conditions in the legs or truss members, and an activated state which generates a counterpressure in the legs or truss members for counteracting the hydrostatic pressure when the legs or truss members are submerged; and activating the pressure generating means for resisting the hydrostatic pressure during the submergence of the legs or truss members at a predetermined differential pressure between the inside and outside of the legs or truss members.

5. A method according to claim 4, wherein the pressure generating means is a gas generating chemical.

6. A method according to claim 4, including at least partly flooding the legs or truss members during installation of the offshore structure and subsequently activating the pressure generating means for deballasting the legs or truss members.

7. A method according to claim 6, including providing a valve in the legs or truss members for venting sea water during deballasting of the tubular.

8. In an offshore structure having a leg or truss member which, in use, is at least partly submerged and exposed to inward hydrostatic pressure and has been deliberately ballasted during installation of the offshore structure, an apparatus comprising:

pressure generating means in the leg or truss member which has a dormant state that exerts no excess pressure inside the leg or truss member, and an activated state which generates a counterpressure in the leg or truss member for counteracting the hydrostatic pressure and deballasting the leg or truss member when said pressure generating means is activated;

manually controlled activating means operatively connected to said pressure generating means for activating said pressure generating means to generate the counterpressure; and a valve in the leg or truss member for discharging ballast contained in the leg or truss member when counterpressure is generated by said pressure generating means.

* * * * *